US007394210B2

(12) United States Patent
Ashdown

(10) Patent No.: US 7,394,210 B2
(45) Date of Patent: Jul. 1, 2008

(54) SYSTEM AND METHOD FOR CONTROLLING LUMINAIRES

(75) Inventor: Ian Ashdown, West Vancouver (CA)

(73) Assignee: TIR Technology LP, Burnaby, BC (CA)

( * ) Notice: Subject to any disclaimer, the term of this patent is extended or adjusted under 35 U.S.C. 154(b) by 0 days.

(21) Appl. No.: 11/241,787

(22) Filed: Sep. 29, 2005

(65) Prior Publication Data

US 2006/0082331 A1 Apr. 20, 2006

Related U.S. Application Data

(60) Provisional application No. 60/614,561, filed on Sep. 29, 2004.

(51) Int. Cl.
*H05B 37/02* (2006.01)

(52) U.S. Cl. ..... 315/291; 315/294; 315/317

(58) Field of Classification Search ..... 315/291–295, 315/312–316, 307–309, 246, 317, 324; 340/5.22–5.25, 340/825.24; 345/39, 47–48
See application file for complete search history.

(56) References Cited

U.S. PATENT DOCUMENTS 3,211,626 A * 10/1965 Nerenstone et al. ..... 376/424

(Continued)

FOREIGN PATENT DOCUMENTS

EP 0 222 360 5/1987

(Continued)

OTHER PUBLICATIONS

C. Badger et al., "Prospects for Monoclonal Antibody therapy of Leukimia and Lymphoma", Cancer vol. 58, (1986) pp. 584-589.

(Continued)

*Primary Examiner*—Thuy Vinh Tran
*Assistant Examiner*—Tung X Le
(74) *Attorney, Agent, or Firm*—Pillsbury Winthrop Shaw Pittman LLP

(57) ABSTRACT

The present invention provides a programmable lighting system comprising a plurality of light-emitting elements and a controller responsive to a hierarchically encoded data input stream. The controller determines and provides appropriate control signals for controlling the characteristics of the light generated by the plurality of light-emitting elements operatively coupled thereto. The data input stream may use a DMX512 or other network protocol and can be hierarchically encoded by varying the value of the START code of the data packets. When a DMX512 or other data packet with a NULL START code or "color" packet is received by the controller, the controller interprets the frames to be intensity control data wherein each frame can correspond to a particular light-emitting element or group of light-emitting elements. The color packet can provide data for the generation of a particular temporal color sequence or a temporal color sequence that is random or any other lighting sequence. When a DMX512 or other data packet with a non-NULL START code or "service" packet is received by the controller, the controller can interpret each START code value independently and can assign or modify one or more attributes of the controller, for example, the particular mode of operation, or an address or serial number may be assigned or modified based on the value of the START code.

15 Claims, 16 Drawing Sheets

U.S. PATENT DOCUMENTS

| | | | | |
|---|---|---|---|---|
| 3,787,752 | A | 1/1974 | Delay | 327/544 |
| 4,090,189 | A | 5/1978 | Fisler | 315/169.1 |
| 4,172,124 | A | 10/1979 | Koprowski et al. | |
| 4,861,581 | A | 8/1989 | Epstein et al. | |
| 4,939,240 | A | 7/1990 | Chu | |
| 5,171,665 | A | 12/1992 | Hellstrom et al. | |
| 5,309,084 | A | 5/1994 | Jiang | 323/321 |
| 5,484,596 | A | 1/1996 | Hanna, Jr. et al. | |
| 5,693,363 | A | 12/1997 | Kuroda et al. | |
| 5,750,102 | A | 5/1998 | Eisenbach et al. | |
| 5,780,033 | A | 7/1998 | Torchilin et al. | |
| 5,783,186 | A | 7/1998 | Arakawa et al. | |
| 5,849,876 | A | 12/1998 | Linsley et al. | |
| 5,869,045 | A | 2/1999 | Hellstrom et al. | |
| 5,869,268 | A | 2/1999 | Kudo et al. | |
| 6,028,527 | A * | 2/2000 | Soenen et al. | 340/5.26 |
| 6,180,357 | B1 | 1/2001 | Young et al. | |
| 7,038,398 | B1 * | 5/2006 | Lys et al. | 315/291 |
| 7,253,566 | B2 * | 8/2007 | Lys et al. | 315/291 |
| 2001/0028227 | A1 * | 10/2001 | Lys et al. | 315/317 |
| 2002/0047628 | A1 * | 4/2002 | Morgan et al. | 315/291 |
| 2003/0030386 | A1 * | 2/2003 | Leeb et al. | 315/291 |
| 2003/0057886 | A1 * | 3/2003 | Lys et al. | 315/291 |
| 2004/0155609 | A1 * | 8/2004 | Lys et al. | 315/292 |
| 2004/0160199 | A1 * | 8/2004 | Morgan et al. | 315/312 |
| 2004/0240890 | A1 * | 12/2004 | Lys et al. | 398/182 |
| 2006/0082331 | A1 * | 4/2006 | Ashdown | 315/291 |

FOREIGN PATENT DOCUMENTS

| | | |
|---|---|---|
| WO | WO 94/18345 | 8/1994 |

OTHER PUBLICATIONS

A. Begg et al., "Rapid Fluorescence-based Assay for Radiosensitivity and Chemoscensivity Testing in mammalian Cells in Vitro", Cancer research, vol. 49, (1986) pp. 565-569.

E. Boven et al., "Monoclonal Antibodies in Cancer Treatment: Where Do We Stand After 10 Years?", Radiotherapy & Oncology, vol. 5 (1986) pp. 109-117.

A. Costa et al., "Implications of Disaggggregation Procedures on Biological Representation of Human Solid Tumours", Cell Tissue Kinet, vol. 20, (1987) pp. 171-80.

Cruse et al., Illustrated Dictionary of Immunology, CRC Press, (1995)p. 280.

S. Dairkee et al., "Partial Enzymatic Degredation of Stroma Allows Enrichment and Expansion of Primary Breast Tumor Cells", Cancer Res. vol. 57. (1997) pp. 1590-1596.

R. Dillman, "Antibodies as Cytotoxic Therapy", Journal of Clinical Oncology, vol. 12, (1994) pp. 1497-1515.

R. Dillman, "Monoclonal Antibodies for Treating Cancer", Annals of Internal Medecine, vol. 111 (1989) pp. 592-603.

M. Disis et al., "Her-2/neu Protein: A Target for Antigen-Specicfc Immunotherapy of Human Cancer", Advances in Cancer Research, vol. 71 (1997) pp. 343-371.

H. Dvorak et al., "Structure of Solid Tumors and their Vasculature: Implications for Therapy With Monoclonal Antibodies", Cancer Cells, vol. 3 (1991) pp. 77-85.

S. Engelhohn et al., "Disaggregation of Human Solid Tumours by Combined Mechanical and Enzymatic methods", Br. J. Cancer vol. 51 (1985) pp. 93-98.

A. Epsstein et al., "Two New Monoclonal Antibodies; Lym-1 and Lyn02, Reactive with Human B-Lymphocytes and Derived Tumours, with Immunodiagnostic and Immunotherapeutic Potential", Cancer research vol. 47 (1987) pp. 830-840.

K. Foon, "Biological Therapy of Cancer", Breast Cancer Research & Treatmetn vol. 7 (1986) pp. 5-14.

B. Fransen et al., "Nonenzymatic Extraction of Cells from Clnical Tumor Material for Analysis of Gene Expression by Two-Dimensional Polyacrylaamide gel Electrophoresis", Electrophoresis, vol. 14 (1993) pp. 1045-1053.

DT Harris et al., "Serotherapy of Cancer", Seminars in Oncology, vol. 16 (1989) pp. 180-198.

Herlyn et al., "Monoclonal Anticolon Carcinoma Antibodies in Complement-Dependent Cytoxicity", Int J. Cancer 27, (1981); pp. 769-774.

E. Holz et al., "Antibody-Based immunotherapeutic Strategies in Colorectal Cancer", Recent Results in Cancer Research, vol. 142 (1996) pp. 381-400.

Horoszewicz et al., "Monoclonal Antibodies to a New Antigenic Marker in Epithelial Prostatic Cells and Serum of Prostatic Cancer Patients", Anticancer Research 7, (1987) pp. 927-936.

V. Kravstov et al., "Automated monitoring of Apoptosis in Suspension Cell Cultures", Laboratory Investigation, vol. 74 (1996) pp. 557-570.

A. Knuth et al, "ADCC reactivity of human melanoma cells with mouse monoclonal antibodies", Proc. Am. Assoc. Cancer Res., 25:1005 (May 1984).

Entertainment Services and Technology Association (2000) Draft BSR E1.11, Entertainment Technology—USITT DMX512-A Asynchronous Serial Digital Data Transmission Standard for Controlling Lighting Equipment and Accessories, Revision 3.

IESNA Lighting Handbook (2000) Ninth Edition, New York, NY: Illuminating Engineering Society of North America, p. 27-4.

United States Institute for Theatre Technology, Inc (USITT) (1990) USITT DMX512/1990 Digital Data Transmission Standard for Dimmers and Controllers.

Wyszecki, G. and Stiles, W.S. (2000) "Color Science: Concepts and Methods, Quantitative Data and Formulae", New York, NY: Wiley-Interscience, pp. 410-424.

Zukauskas, A. et al. (2002) Introduction to Solid-State Lighting, New York, NY: Wiley-Interscience, p. 136.

* cited by examiner

| DESIG | DESCRIPTION | MIN | TYP | MAX | UNIT |
|---|---|---|---|---|---|
| 1 | "SPACE" FOR BREAK | 88 | 88 | | uSEC |
| 2 | "MARK" BETWEEN BREAK | 8.00 | | - | uSEC |
| | & START CODE | | - | 1.00 | SEC |
| 3 | FRAME TIME | 43.12 | 44.0 | 44.48 | uSEC |
| 4 | START BIT | 3.92 | 4.0 | 4.08 | uSEC |
| 5 | LEAST SIGNIFICANT DATA BIT | 3.92 | 4.0 | 4.08 | uSEC |
| 6 | MOST SIGNIFICANT DATA BIT | 3.92 | 4.0 | 4.08 | uSEC |
| 7 | STOP BIT | 3.92 | 4.0 | 4.08 | uSEC |
| 8 | "MARK" TIME BETWEEN FRAMES | 0 | 0 | 1.00 | SEC |
| 9 | "MARK" TIME BETWEEN PACKETS | 0 | - | 1.00 | SEC |

SYSTEM AND METHOD FOR CONTROLLING LUMINAIRES

CROSS REFERENCE TO RELATED APPLICATIONS

This application claims the benefit of priority to U.S. Provisional Application No. 60/614,561, filed on Sep. 29, 2004, which is fully incorporated herein by reference and for all purposes.

FIELD OF THE INVENTION

The present invention relates to the field of lighting and more specifically to the control of lighting systems.

BACKGROUND

Recent advances in the development of semiconductor and organic light-emitting diodes (LEDs and OLEDs) have made these solid-state devices suitable for use in general illumination applications, including architectural, entertainment, and roadway lighting, for example. As such, these devices are becoming increasingly competitive with light sources such as incandescent, fluorescent, and high-intensity discharge lamps.

An advantage of LEDs is that their turn-on and turn-off times are typically less than 100 nanoseconds. The average luminous intensity of an LED can therefore be controlled using a fixed constant-current power supply together with pulse width modulation (PWM), for example, of the LED drive current, wherein the time-averaged luminous intensity is typically linearly proportional to the PWM duty cycle. This technique of using PWM signals is disclosed in U.S. Pat. No. 4,090,189. Today, PWM is typically the preferred method for LED luminous intensity control in that it offers linear control over a range of three decades (1000:1) or more without suffering power losses through current-limiting resistors, uneven luminous intensities in LED arrays, and noticeable colour shifts as identified by A. Zukauskas, M. S. Schur, and R. Caska, 2002, *Introduction to Solid-State Lighting*. New York, N.Y., Wiley-Interscience, p. 136. The PWM signals used to control the LEDs are preferably generated by microcontrollers and associated peripheral hardware.

An application of LEDs is in theatrical lighting fixtures. These fixtures are commonly controlled using an industry-standard asynchronous serial communications network protocol referred to as "DMX512." This protocol was introduced in 1990 by the United States Institute for Theatre Technology (USITT) and is presented in their publication, "USITT DMX512/1990 Digital Data Transmission Standard for Dimmers and Controllers". Most theatrical lighting manufacturers quickly adopted the DMX512 protocol as an industry standard.

As originally designed, DMX512 was intended primarily to control up to 512 lighting fixture dimmer controls. To this end, the protocol comprises a serial stream of data transmitted over an RS-485 multidrop serial communication link, wherein each data "packet" comprises a packet header, an 8-bit START code, and 1 to 512 8-bit data bytes called "frames." FIG. 1 illustrates a timing diagram for control of a lighting system using the DMX512 protocol. When the start code is NULL, the data bytes are interpreted as dimmer control settings, thereby allowing up to 256 discrete intensity levels for each lighting fixture. The position of each frame within the packet defines the DMX512 "address" of the lighting fixture. In operation, the lighting fixture receives each packet and extracts the data frame corresponding to its fixed DMX512 address, as illustrated in the configuration of FIG. 2.

Where a theatrical lighting fixture has additional components such as color filter wheels, moveable lenses and irises, or motorized mounts, the lighting fixture may have multiple DMX addresses (referred to as DMX "channels") to independently control these components.

The DMX512 protocol also makes provision for 255 optional START codes wherein the START code value is between 1 and 255, which the USITT publication cited above states are "for future expansion and flexibility."

The Entertainment Service and Technology Association released a document describing a proposed successor of the DMX512/1990 protocol, "Draft BSR E1.11, Entertainment Technology—USITT DMX512-A Asynchronous Serial Digital Data Transmission Standard for controlling Lighting Equipment and Accessories, Revision 3" in 2000. The purpose of this document is primarily to more precisely define the scope of the USITT DMX512 serial network protocol and related RS-485 network physical layer. It also however formally defines Alternate START Codes wherein the START code is an 8-bit value other than NULL. Annex E of this document defines reserved Alternate START Codes for special purposes and future development of the draft standard. These include a Manufacturer ID code intended to identify proprietary data packets and a System Information Packet intended to identify manufacturers' specific products.

Both DMX512/1990 and its proposed successor DMX512-A are real-time lighting fixture control protocols in that each data frame represents the current intensity for the lighting fixture dimmer, wherein each data packet is transmitted at least 44 times a second in accordance with the DMX512 protocol timing requirements.

With recent advances in LED lighting technology, it has become desirable to execute complex lighting control sequences using the DMX512 protocol and RS-485 asynchronous serial communication. Some of the problems, however, with using the existing DMX512 protocols and RS-485 asynchronous serial communication in a manner for both communication and synchronization of a networked ensemble of lighting fixtures whose operation comprises complex and synchronized lighting control sequences, are that the DMX512 protocol does not support phase shifting of the data stream, nor does the protocol support multiple interpretations of the data stream. Furthermore, the DMX512 protocol does not support the transmission of hierarchical data, remote querying of a dimmer control address, nor autonomous synchronized color fading. In addition, a problem with synchronized strobing of light sources is that timing inaccuracies can cause perceptible differences in light output.

It can be advantageous to address logical groups of lighting fixtures and using the current state-of-the-art in DMX512 technology, this requires that the DMX512 master controller maintain a list of DMX512 addresses assigned to each group, and to sequentially address each of the lighting fixtures in a DMX512 color packet. The disadvantage of this approach is that the DMX512 packet can take up to 44 milliseconds to transmit in its entirety. In the worst case scenario therefore, there is a corresponding delay of 44 milliseconds between lighting fixtures in the same logical group responding to a common command. This delay was not of particular importance when the DMX512 protocol was introduced in 1990, as almost all theatrical light sources consisted of incandescent lamps with response times measured in tens of milliseconds. Delays in responding to a common command were therefore mostly imperceptible. However, the introduction of high flux light-emitting diodes suitable for entertainment and architectural applications has reduced the response time from tens of milliseconds to tens of nanoseconds. Consequently, delays of even a few milliseconds between LED-based lighting fixtures responding to a common command can be noticeable and objectionable.

Furthermore, it is common practice with theatrical lighting systems to assign DMX512 addresses to lighting fixtures after they are installed, often in relatively inaccessible locations. If an error is made in assigning a DMX512 address, it becomes a trial-and-error process to determine why the lighting fixture is not responding to the DMX512 master controller.

Furthermore, it is known that perceived brightness of LEDs has a non-linear relationship to the radiometric intensities of the LEDs, including for example the Helmholtz-Kohlrausch effect and Bezold-Brücke phenomenon. This relationship between perceived brightness and radiometric intensities is described by, for example, Wyszecki, G., and W. S. Stiles in "Color Science: Concepts and Methods, Quantitative Data and Formulae," New York, N.Y.: Wiley-Interscience, 2000. This relationship results in a perceived non-linear brightness when using linear control parameters. The relationship between perceived lightness and measured illuminance of an object can be approximately represented by Steven's Law defined as follows:

$$B=\alpha L^{0.5} \tag{1}$$

where B is the perceived lightness, $\alpha$ is a scaling constant, and L is the luminance (measured in candela per square meter per steradian) of the illuminated object at a given point on its surface.

Stevens' Law (Equation 1) has been used in theatrical lighting fixture dimmers to linearize the relationship between the raw color represented by, for example, a dimmer control panel slide resistor or DMX512 color packet frame values and the perceived lightness of illuminated surfaces as described in IESNA, 2000, IESNA Lighting Handbook, Ninth Edition. New York, N.Y., Illuminating Engineering Society of North America, where it is commonly referred to as "square law dimming." However, this approach assumes a single light source for which only the intensity can be varied as described in U.S. Pat. No. 5,309,084, for example. Therefore, problems arise when attempting to apply this technique to multicolor light sources, such as for example a light fixture with red, green, and blue LEDs, whose intensities can be independently or interdependently varied.

Thus, there is a need for a solution that allows the DMX protocol to be used for control of lighting fixtures which can overcome the problems identified in the prior art.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a system and method for controlling luminaires. In accordance with an aspect of the present invention, there is provided a programmable lighting system comprising a plurality of light-emitting elements for generating light output of one or more wavelengths; and a controller operatively coupled to the plurality of light-emitting elements, the controller for controlling the light output of the light-emitting elements, the controller being responsive to hierarchically encoded input data, the hierarchically encoded input data defining one or more attributes of the controller; wherein the controller is adapted for connection to a source of power.

In accordance with another aspect of the invention, there is provided a method for controlling a programmable lighting system having a controller and a plurality of light-emitting elements operatively coupled thereto, the method comprising the steps of generating hierarchically encoded input data, the hierarchically encoded input data defining one or more attributes of the controller; transmitting hierarchically encoded input data to the controller; assigning or modifying the one or more attributes of the controller in response to the hierarchically encoded input data; and controlling light output of the plurality of light-emitting elements by the controller.

DETAILED DESCRIPTION OF THE INVENTION

Definitions

Figure 1:
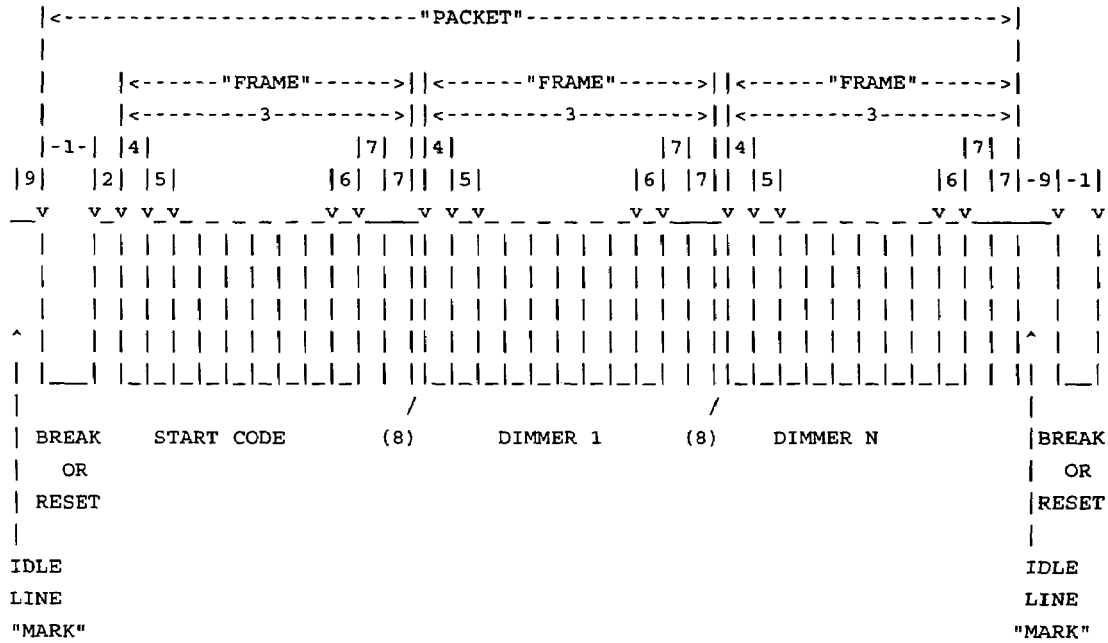
FIGURE 1 (Prior Art)
FIG. 1 illustrates a timing diagram illustrating the DMX512 packet protocol and the relationship of the START code frame to the subsequent data frames, according to the prior art.
Figure 2:
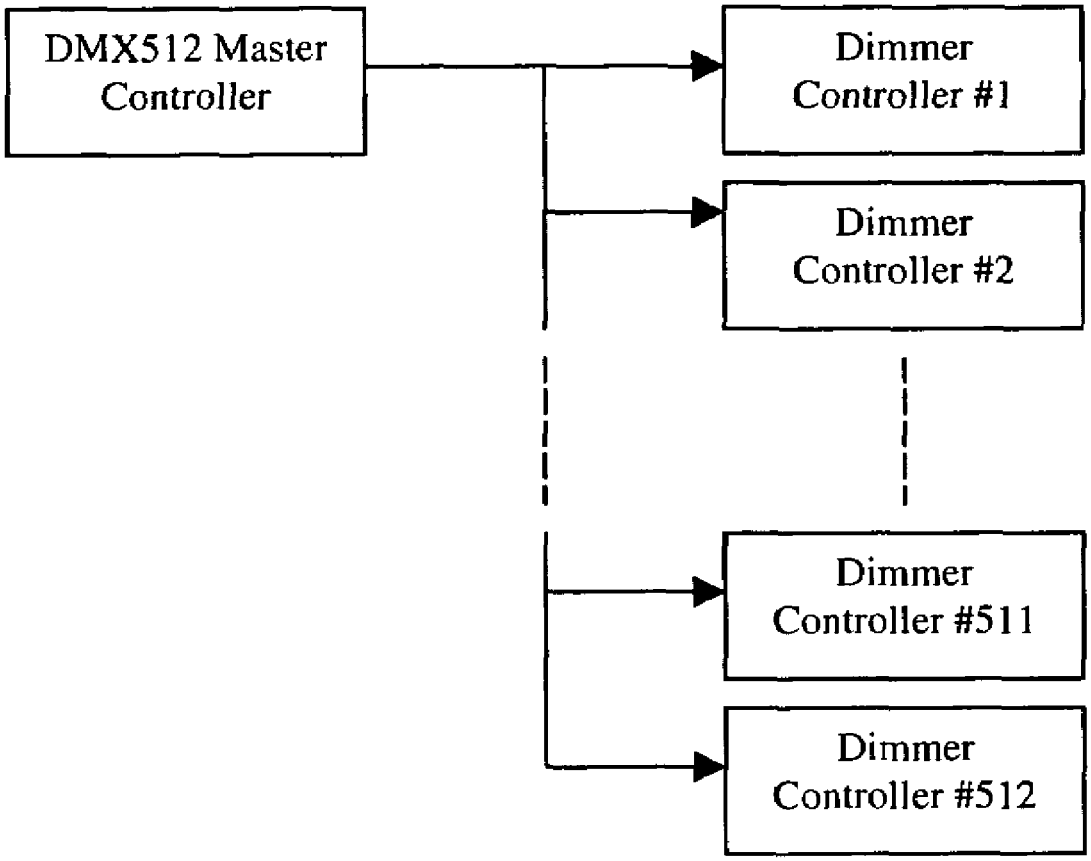
FIGURE 2 (Prior Art)
FIG. 2 illustrates a block diagram illustrating the configuration of an RS-485 asynchronous serial communications network transmitting data from a DMX512 controller to a plurality of addressable light fixture dimmer controls, according to the prior art.

The term "light-emitting element" is used to define any device that emits radiation in the visible region of the electromagnetic spectrum, when a potential difference is applied across it or a current is passed through it, for example, a semiconductor, organic, polymer or high-flux light-emitting diodes (LEDs) or other similar devices as would be readily understood. It would be obvious to one skilled in the art that elements that emit other forms of radiation such as infrared or ultraviolet radiation may also be used if desired in the present invention in place or in combination with light-emitting elements emitting visible light.

The terms "light", "illumination" and "lighting" are used interchangeably to define radiation in any region, or combination of regions, of the electromagnetic spectrum, for example, the visible region, infrared and/or ultraviolet region.

Unless defined otherwise, all technical and scientific terms used herein have the same meaning as commonly understood by one of ordinary skill in the art to which this invention belongs.

The present invention provides a programmable lighting system comprising a plurality of light-emitting elements and a controller responsive to a hierarchically encoded data input stream. The controller determines and provides appropriate control signals for controlling the characteristics of the light generated by the plurality of light-emitting elements operatively coupled thereto. The data input stream may use a DMX512 or other network protocol and can be hierarchically encoded by varying the value of the START code of the data packets. When a DMX512 or other data packet with a NULL START code, for example, also referred to as a "color" packet, is received by the controller, the controller interprets the frames to be intensity control data wherein each frame can correspond to a particular light-emitting element or group of light-emitting elements. The color packet can provide data for the generation of a particular temporal color sequence or a temporal color sequence that is random, for example, or any other lighting sequence, as would be readily understood by a worker skilled in the art. When a DMX or other data packet with a non-NULL START code, for example, also referred to as a "service" packet, is received by the controller, the controller can interpret each START code value independently and can assign or modify one or more attributes of the controller, for example, the particular mode of operation, or an address or serial number may be assigned or modified based on the value of the START code. Other attributes of the controller known to a worker skilled in the art, may also be assigned or modified in this manner.

Controller

The controller may comprise a plurality of digital-to-analog converters for receiving intensity control data and providing a signal for driving each light-emitting element or group of light-emitting elements. The controller may control the light-emitting elements using a pulse-width modulation signal or a pulse code modulation signal. Other methods of intensity control of the light-emitting elements may also be used, as would be readily understood by a worker skilled in the art. Each control signal may be individually provided to a particular light-emitting element or group of light-emitting elements, or may be multiplexed to further groups of light-emitting elements. Other methods of providing the control signal to the light-emitting elements may also be used as would be readily understood by a worker skilled in the art.

The controller comprises memory, which can store various control data packets including color packets and service packets, and further comprises a port for receipt of input control data. The data used for control of the lighting system may be received as input data via the port and stored in the memory, or may be preset and stored in the memory during manufacture of the lighting system. The data received by the lighting system may be a preset control sequence or may be user specified. The intensity of the light emitted from the lighting system may also be controlled by real-time data input to the lighting system. Therefore, the lighting system may function autonomously, semi-autonomously or by means of real-time data.

In one embodiment, the controller may be implemented as an application-specific integrated circuit (ASIC) with additional discrete components to control the light source drive current. As may be understood by a worker skilled in the art, the controller may also be implemented as a programmable logic device (PLD), field programmable gate array (FPGA), microcontroller, an assembly of discrete digital logic and analog components, any other such component or components, or any suitable combination thereof.

In one embodiment of the present invention, the input control data is provided to a plurality of lighting systems by means of an asynchronous serial network. This configuration can have the advantage of being able to synchronize the output of the various lighting systems. For example, the light output of individual lighting systems may be phase shifted, simultaneously output, provide interpolated fade colors, or provide any other effect as would be readily understood. A master controller may also be used to control a plurality of lighting systems, for example. In one embodiment of the present invention, the controller may further comprise a real-time clock for synchronization of the lighting systems, and synchronized time stamping of data packets.

In one embodiment, when the light output of a plurality of lighting systems are to be synchronized, the memory can be used to store control data such that no delays, that can typically occur with the use of a serial data source, are observed. By storing the data in the memory, the particular control data required for each lighting system is available simultaneously to each lighting system whose light output is to be synchronized.

In further embodiments, each lighting system may have more than one address. For example, in one embodiment, the lighting system may be comprised of a multiplicity of red, green, blue, and optionally amber light-emitting elements, for example light-emitting diodes (LEDs), with one DMX channel, and thus address, dedicated to the intensity control of each LED color. In another embodiment, the START code value may dictate which control data to use from a series of control data stored in the memory or input real-time to the controller. For example, control data preset at manufacture may be used, or control data defined by a user may be used, or control data from packets with a NULL START code may be used. With the use of various non-NULL START codes, other modes of operation are also possible, as would be readily understood by a worker skilled in the art. Therefore, by varying the value of the non-NULL START code, the lighting system may be programmed to behave in various desired modes.

In one embodiment of the present invention, the lighting system further comprises a thermistor for monitoring the temperature of the lighting system. These temperature measurements may be fed to an analog-to-digital converter, for example, within the controller and the particular drive currents provided to the light-emitting elements may be independently or interdependently varied based on the particular temperature measured by thermistor. In further embodiments of the present invention, other methods of measuring temperature may also be used as would be readily understood by a worker skilled in the art.

A particular advantage of the use of service packets as disclosed above, is that they can be configured to be compatible with existing DMX512-compatible lighting fixtures and equipment, in that USITT DMX512/1990 and ESTA BSR E1.11 require that such devices must ignore DMX512 data packets with non-NULL START codes unless they are capable of correctly responding to the data embedded within the following data frames.

While real-time operation was reasonable and practical with state-of-the-art electronics for theatrical lighting fixture dimmers in 1990, advancing technology has made it possible to implement autonomous lighting fixture controllers that can execute complex preset or user-defined lighting control sequences, where the control sequence information is stored in on-board memory. In this mode of operation, it can be economical and useful to employ the DMX512 network protocol and RS-485 asynchronous serial communication in a manner that both communication and synchronization of a networked ensemble of lighting fixtures whose operational characteristics includes a complex and synchronized lighting control sequence or sequences that may be factory preset, user-defined, or partially randomized.

Figure 3:
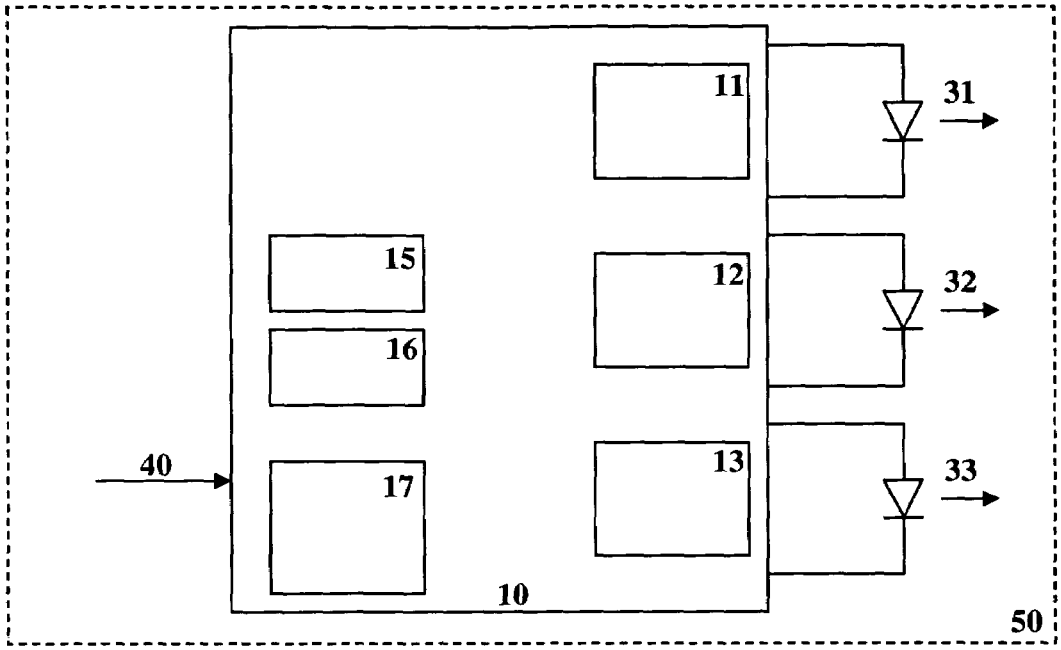
FIG. 3 illustrates a block diagram of a programmable lighting system according to one embodiment of the present invention.
Figure 4:
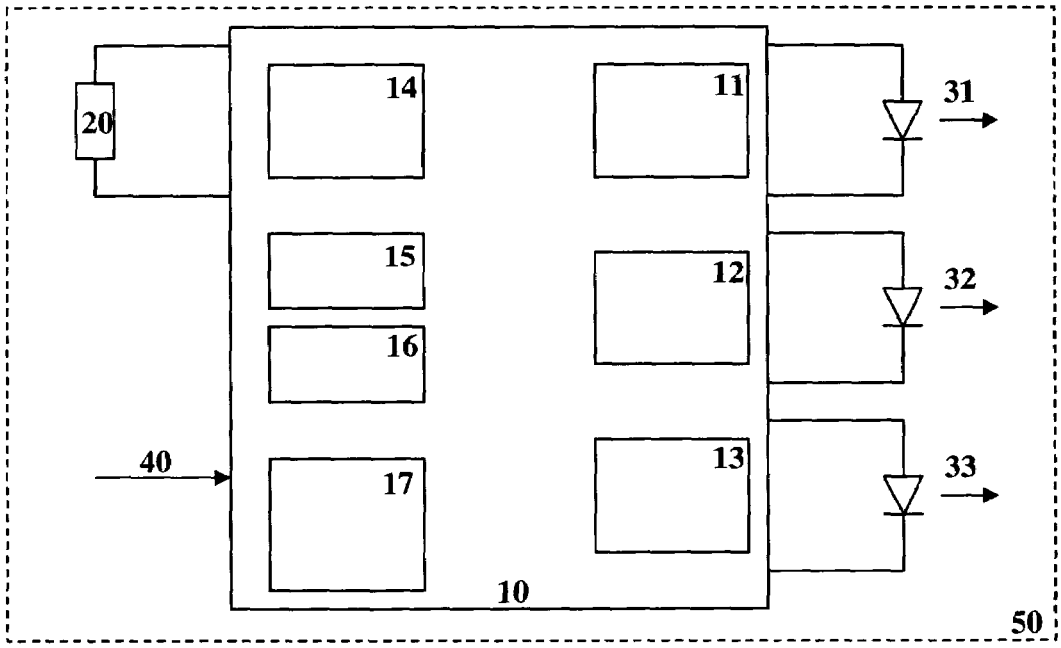
FIG. 4 illustrates a block diagram of a programmable lighting system according to another embodiment of the present invention.

FIG. 3 illustrates one embodiment of the present invention in which a hierarchically encoded data stream is used to control a programmable lighting system 50. Controller 10 comprises a serial port 17 that is configured to receive DMX512 or similar data packets via RS-485 serial data line 40, a real-time clock 15 to synchronize color sequences, memory 16 to store factory preset or user-defined commands to generate color sequences, and a multiplicity of digital-to-analog or pulse width modulation converters 11, 12, and 13 to independently control the drive current delivered to light-emitting elements 31, 32, and 33, respectively. It would be readily understood that each of light-emitting elements 31, 32, and 33 can equally be a group or string of light-emitting elements, for example. Programmable lighting system 50 may be one of a multiplicity of programmable light sources that may operate autonomously or in synchrony when connected to a DMX512 or similar data communications network. FIG. 4 illustrates a further embodiment which comprises a thermistor 20 or other form of thermal sensor and an analog-to-digital converter 14 for measurement of the temperature of the lighting system.

Examples of color sequences generated by a controller 10 operating autonomously may include, for example:

- Displaying a predetermined constant color;
- Smoothly fading between a sequence of predetermined colors with fixed hold and fade times;
- Smoothly fading between a sequence of random colors with fixed hold and fade times;
- Smoothly fading between a sequence of predetermined colors with random hold and fade times;
- Smoothly fading between a sequence of random colors with random fade and hold times;
- Abruptly switching between a sequence of predetermined colors with fixed hold and fade times;
- Abruptly switching between a sequence of random colors with fixed hold and fade times;
- Abruptly switching between a sequence of predetermined colors with random hold and fade times;
- Abruptly switching between a sequence of random colors with random fade and hold times;
- Displaying a predetermined constant color with a repeating flash (or "strobe") of a second constant color being displayed at constant intervals and with constant strobe duration;
- Displaying a predetermined constant color with a repeating flash of a second random color being displayed at constant intervals and with random strobe duration;
- Displaying a predetermined constant color with a repeating flash of a second constant color being displayed at random intervals and with constant strobe duration; and
- Displaying a predetermined constant color with a repeating flash of a second random color being displayed at constant intervals and with random strobe duration.

Examples of color sequences generated by a multiplicity of controllers 10 operating in synchrony when connected to a DMX512 or similar network include, for example:

- The above examples of autonomous operation wherein said controllers 10 generate the same sequence at the same time; and
- The above examples of autonomous operation wherein said controllers 10 generate the same sequence with a constant predetermined time delay (or "phase shift") that may differ for each controller 10. For example, each controller may generate a color sequence wherein the colors are smoothly faded between a sequence of predetermined colors with fixed hold and fade times. If the light fixtures with controllers 10 are physically arranged in a linear pattern and each controller is phase shifted by a constant amount from its preceding controller in the pattern, the color sequence will be perceived to "flow" along the linear pattern, similar to moving message signs and movie theatre marquee lighting.

Hierarchical Encoding

Hierarchical encoding of the data stream used to control lighting systems according to the present invention is achieved by the use of non-NULL START codes in the data packets. The values assigned as the non-NULL START codes enable particular light output sequences to be achieved by the light sources being controlled by the data stream, where these output sequences may be complex and autonomous sequences or in synchrony with other light sources.

When a DMX packet with a NULL START code, also referred to as a "color" packet, is received by a particular lighting system, the controller extracts the DMX, or similar, frame data corresponding to its fixed DMX address and sets the light source intensity according to the frame data value. When a DMX packet with a specific non-NULL START code, also referred to as a "service" packet, is received by the lighting system, the controller examines the START code and, depending on its value, enters a particular mode of operation. For example, in one embodiment, the START code packet may be of Type A which initiates a System Data mode, Type B which initiates a User-Defined Preset mode, Type C which initiates a Factory Preset mode, or Type D that initiates a Synchronization mode. The frame data associated with each of the non-NULL START codes provides the data required to perform the task defined by the particular mode of operation.

Service Packet Type A—System Data Mode

A service packet Type A enables an external DMX512 master controller to upload user-defined system data to the memory 16 of controller 10. Whereas a conventional DMX512-compatible theatrical lighting fixture may have one or more DMX512 addresses that are manually determined by switch settings, the present invention enables an external DMX512 master controller to change the DMX512 address or addresses of controller 10 by embedding the new address or addresses in a Type A service packet.

It is often advantageous to address logical groups of lighting fixtures. In one embodiment of the present invention a DMX512 address is assigned to each color channel, for example to red, green and blue and optionally amber, and a single group address can be assigned to the controller 10. Upon receipt of a Type A service packet with a matching group address, this format of address assignment can enable all controllers 10 connected to a DMX512 serial network to respond simultaneously to a common command, thereby reducing the response time of a logical group of lighting fixtures responding to a common command.

In addition, the three DMX512 addresses and single group address assigned to a controller 10 are stored in memory 16. A Type A service packet can therefore be issued to a single controller 10 with a matching DMX512 address to update its DMX512 address or its group address. Similarly, a Type A service packet can be issued to a multiplicity of controllers 10 with a matching group address to update their common group address.

In one embodiment each controller 10 can be assigned a unique serial number in the factory, using a Type A service packet to store this serial number in memory 16. With unique serial numbers, a lighting fixture can be unambiguously addressed with a Type A service packet and its DMX address set to a known value without having to physically access the lighting fixture after it has been installed, thereby saving both time and money when the reassignment of a DMX address of a controller is required.

In a further embodiment, unique "broadcast" values can be assigned for DMX addresses, group addresses, and serial numbers such that a command may be simultaneously sent to all controllers 10 connected to a DMX512 network via a Type A service packet.

Therefore, the present invention can provide a means for enabling one or a multiplicity of DMX512 addresses to be assigned to a controller 10 in order to provide a hierarchy of group addresses, DMX512 addresses, and serial numbers. The present invention can further extend this hierarchy to include broadcast group addresses, broadcast DMX512 addresses, and broadcast serial numbers.

Service Packet Type B—User-Defined Preset Mode

A service packet Type B enables the user, via a DMX512 master controller, to specify user-defined color sequences to be stored in the memory 16 of controller 10 and later autonomously executed by said controller.

Service Packet Type C—Factory Preset Mode

Service packet Type C enables the user, via a DMX512 master controller, to select factory preset color sequences that are stored in the memory 16 of controller 10 and later autonomously executed by said controller.

Service Packet Type D—Synchronization Mode

Service packet Type D enables a DMX512 master controller to transmit periodic time synchronization information to all controllers 10 connected to the DMX512 network. This overcomes the tendency of the real-time clocks 15 of each controller 10 to drift out of synchronization over time.

In further embodiments, other service packet types are also possible as would be readily understood a by a worker skilled in the art. The service packet types may be used to provide additional flexibility in the control of light sources that are programmed to respond to START codes of particular types.

Perceived Brightness Non-Linearity

As stated earlier, there is a non-linear relationship between the perceived lightness and measured illuminance of an object illuminated by a light source, which can be approximately represented by Steven's Law, Equation 1.

In one embodiment of the present invention, in which more than a single light source is used to produce illumination, Equation 1 may be modified such that these perceptual issues are appropriately modeled to maintain the appearance of constant chromaticity as the red, green, and blue light sources, for example, are dimmed (the Bezold-Brücke phenomenon), and conversely to maintain the appearance of constant lightness as the color is changed (the Helmholtz-Kohlrausch effect).

There is another, similar form of Steven's Law that relates the perceived brightness of a small source to the measured intensity of the light source and is given below:

$$B=\rho I^{0.33} \tag{2}$$

where B is the perceived brightness, ρ is another scaling constant, and I is the intensity (measured in candela) of the light source.

This form of Steven's Law (Equation 2) has not previously been used in theatrical lighting fixture dimmers, likely because there is rarely a need to view their light sources directly. However, the small emitting area of LEDs (typically less than one square millimetre) makes it practical to design lighting fixtures wherein the light sources are intended to be viewed directly. These lighting fixtures therefore require the application of Equation 2 as a "cubic law dimming" to linearize the relationship between the raw color and the perceived brightness of the LED-based light sources.

In one embodiment of the present invention, an algorithm within the controller of the light source performs a perceptual correction factor calculation for the raw color of each LED type and outputs the perceptually corrected drive current value to the digital-to-analog converters 11, 12 and 13. In another embodiment, the duty cycles of corresponding pulse width modulators are set such that they are perceptually corrected.

In one embodiment of the present invention, the perceptual correction factor can be determined using Equation 2, when cubic law dimming is desired. As an example and with reference to the system components as illustrated in FIG. 3, when cubic law dimming is desired and the intensity value I is defined by a color packet received by controller 10, the value B is calculated in accordance with Equation 2 with an appropriate constant scaling factor ρ such that the range of B is constrained to be within a desired range (for example, 0 to 1024) for the range of possible color values (for example, 0 to 255). This value B is then output to one of the digital-to-analog converters 11, 12, and 13 for control of the intensity of the associated light-emitting element or group of light-emitting elements 31, 32, or 33. In one embodiment of the present invention, scaling factor ρ can be selected such that the output range of B is the full-scale range of the digital-to-analog converters.

For a better understanding of the invention described herein, the following example is set forth. It should be understood that this example is for illustrative purposes only. Therefore, it should not limit the scope of this invention in any way.

EXAMPLE

The following example illustrates one embodiment of the detailed behaviour and steps performed for the embodiment of the present invention illustrated in FIG. 4. This behaviour and steps performed is illustrated by means of a series of flow charts representing the functional operation of a lighting system controlled by a data stream configured according to one embodiment of the present invention.

Figure 5:
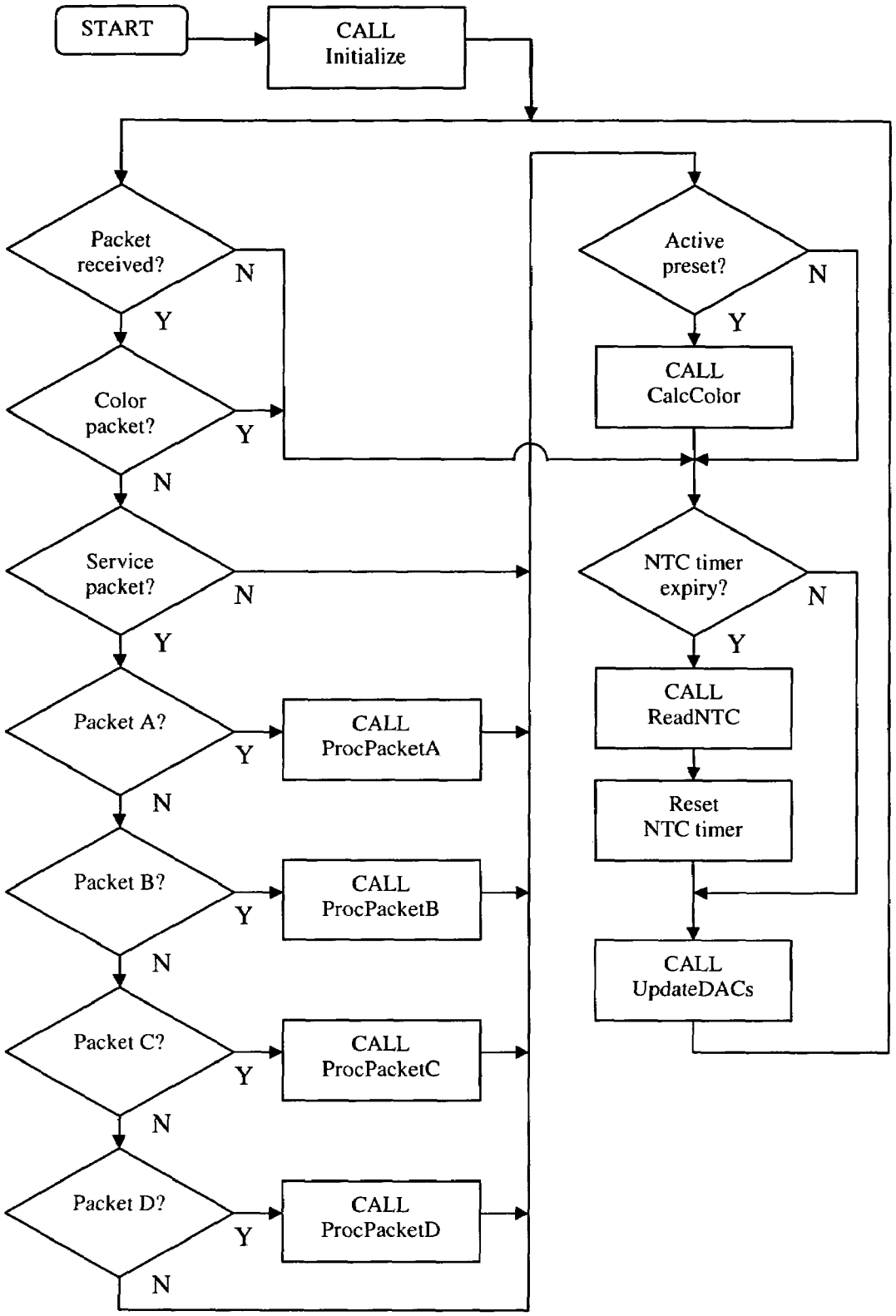
FIG. 5 illustrates a flow chart representing the main or executive function, Main, that describes the functional operation threreof according to one embodiment of the present invention.

Referring to FIG. 5, the controller 10 enters the executive function Main upon energization and immediately calls the subroutine Initialize (FIG. 6) to initialize the controller before entering an infinite loop that is repeatedly executed until the controller is de-energized. Main then repeatedly checks the output of the serial port 17 for the presence of a DMX512 data packet. If a valid data packet has not been received, Main determines whether the periodic NTC thermistor timer expired. If the timer has expired, Main calls the subroutine ReadNTC to determine the current temperature and if necessary derates the drive current provided to the light-emitting elements, for example LEDs, to prevent overheating. Main then calls the subroutine UpdateDACs to update the analog drive current (or pulse width modulation duty factor) provided to the light-emitting elements before looping to check again for a valid data packet.

If a valid data packet has been received, Main determines whether it is a color packet, in which case the packet is identified by a NULL START code. If the data packet is a color packet, Main proceeds to check the NTC thermistor timer expiry as above. Otherwise, Main determines whether the data packet it is a service packet, in which case the packet is identified by a specific non-NULL START code. If the data packet is a service packet, Main proceeds to call one of subroutines ProcPacketA, ProcPacketB, ProcPacketC, or ProcPacketD, which is dependent on the determined service packet type, defined by the non-NULL START code. Each of these subroutines processes the data embedded within the service packet.

Upon return from the chosen packet processing subroutine, Main determines whether the controller 10 is currently executing a user-defined or factory preset color sequence. If this is the case, Main calls the subroutine CalcColor to determine the current color to be displayed. Main then proceeds to check the NTC thermistor timer expiry as described above.

Figure 6:
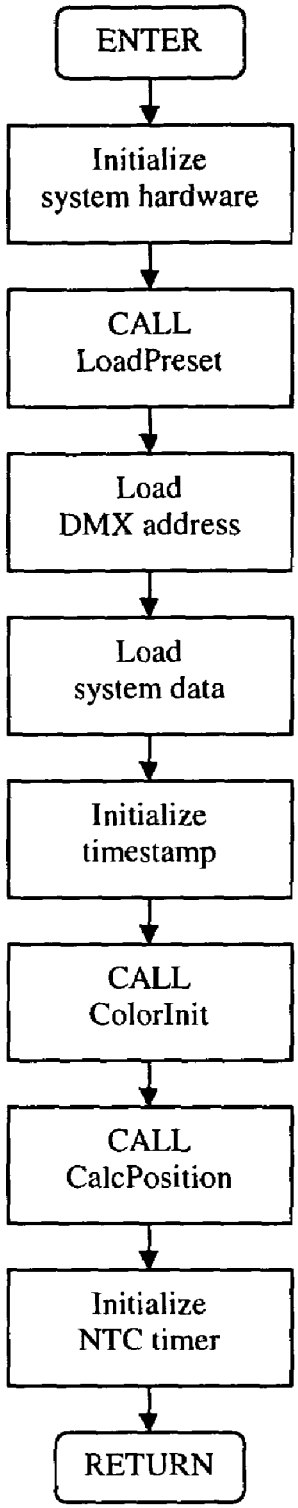
FIG. 6 illustrates a flow chart that represents the functional initialization subroutine, Initialize, which is called by the Main function, according to one embodiment of the present invention.

Referring to FIG. 6, the subroutine Initialize first initializes the controller 10 hardware and peripheral devices associated therewith. It then calls the subroutine LoadPreset to load the specified color sequence that is stored in memory 16. Initialize then loads the current DMX512 address (or addresses) of controller 10 that are stored in memory 16, loads controller-dependent system data from memory 16, initializes the controller 10 synchronization timestamp, calls the subroutine ColorInit to initializes the color sequence array indices, calls the subroutine CalcPosition to initialize the color sequence timer, and initializes the NTC thermistor timer before returning to the calling function, Main. In one embodiment, the color sequence array comprises an array of predefined colors, implemented as a triplet of intensity values for the red, green, and blue light-emitting elements 31, 32, and 33, a specified hold time for each color wherein the color remains constant, and a specified fade interval during which the color is progressively blended with the next color in the repeating sequence. The color sequence timer determines the temporal position within the sequence.

Figure 7:
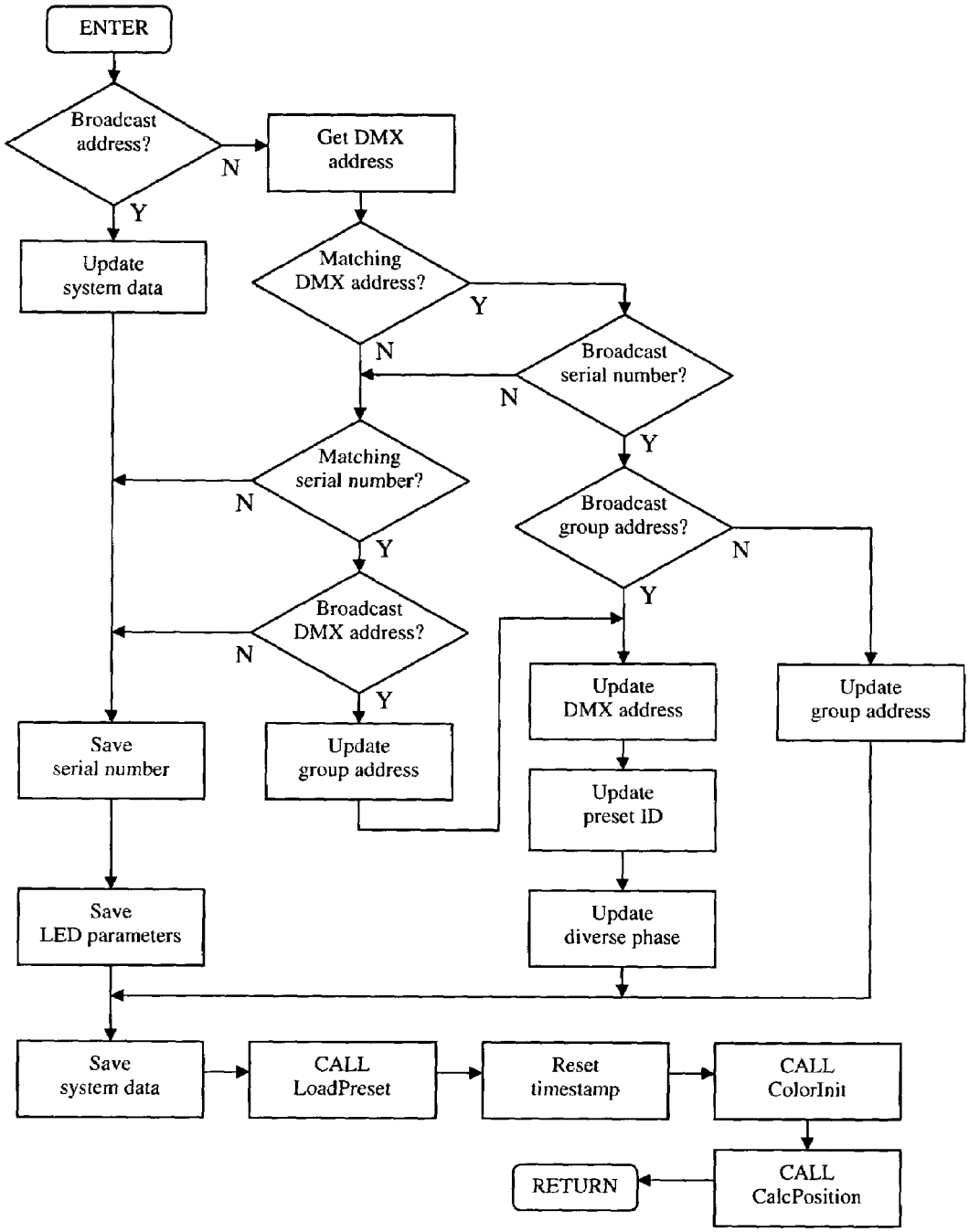
FIG. 7 illustrates a flow chart that represents the functional Packet A handler subroutine, ProcPacketA, which is called by the Main function, according to one embodiment of the present invention.

Referring to FIG. 7, the subroutine ProcPacketA first determines whether the packet address (which is a field within the Type A packet data structure) is a broadcast address (which can be defined as a Boolean combination of a broadcast group address, a broadcast DMX512 address, and a broadcast serial number). If the packet address is a broadcast address, the system data is updated, including new values for the controller group address and DMX512 address, following which the serial number and light-emitting element parameters are also updated. In one embodiment, this functionality can be employed for factory initialization of the controller 10.

If the packet address is not a broadcast address, ProcPacketA then determines whether the packet DMX512 address (which is another field within the Type A packet data structure) matches the current controller 10 DMX512 address. If 1) there is a match or 2) if there is not a match and the packet serial number is a broadcast serial number, ProcPacketA determines whether the packet serial number matches the current controller 10 serial number and whether the packet DMX512 address is a broadcast DMX512 address. If both of these conditions are true, ProcPacketA updates the current group address, the DMX512 address, the color sequence identifier (called the "preset ID"), and the color sequence synchronization phase shift (called the "diverse phase").

If the packet DMX512 address matches the current controller 10 DMX512 address and the packet serial number is not a broadcast serial number, ProcPacketA then determines whether the packet group address is a broadcast group address. If it is, then ProcPacket A updates the current group address, the DMX512 address, the preset ID, and diverse phase; otherwise ProcPacketA updates the current group address.

ProcPacketA subsequently saves the new system data in memory 16 before calling subroutine LoadPreset to load the current color sequence data according to the current preset ID. ProcPacketA then resets the synchronization timestamp, calls the subroutine ColorInit to initialize the color sequence array indices, and calls the subroutine CalcPosition to determine the color sequence position before returning to the calling function Main.

Figure 8:
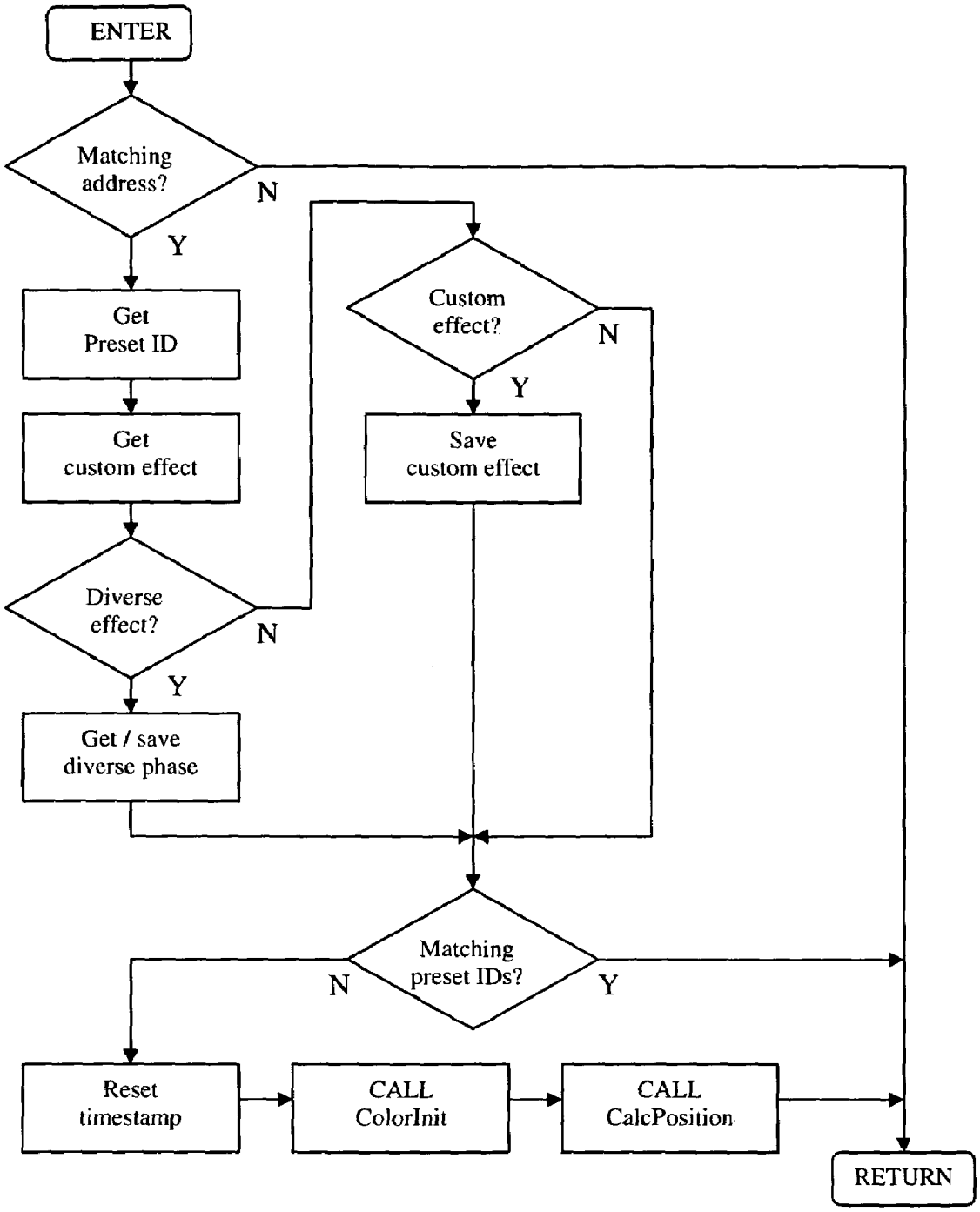
FIG. 8 illustrates a flow chart that represents the functional Packet B handler subroutine, ProcPacketB, which is called by the Main function, according to one embodiment of the present invention.

Referring to FIG. 8, the subroutine ProcPacketB first checks for a matching address (which is defined as a matching group address or a matching DMX512 address or a matching serial address). If the packet address matches the current controller 10 address, ProcPacketB reads the preset ID and user-defined or custom color sequence data (if any) from the packet data structure.

ProcPacketB then determines whether the color sequence as specified by the preset ID is a "diverse effect," which is a factory-defined color sequence with a user-defined phase shift (diverse phase). If it is, ProcPacketB reads the diverse phase from the packet data structure and saves it in memory 16.

If the specified color sequence is not a diverse effect, ProcPacketB next determines whether it is a custom effect. If it is a custom effect, ProcPacketB stores the custom effect color sequence data in memory 16.

ProcPacketB then determines whether the packet preset ID matches the current controller 10 preset ID. If there is a match, ProcPacketB resets the controller 10 synchronization timestamp, calls the subroutine ColorInit to initialize the color sequence array indices and, calls the subroutine CalcPosition to determine the color sequence position before returning to the calling function, Main.

Figure 9:
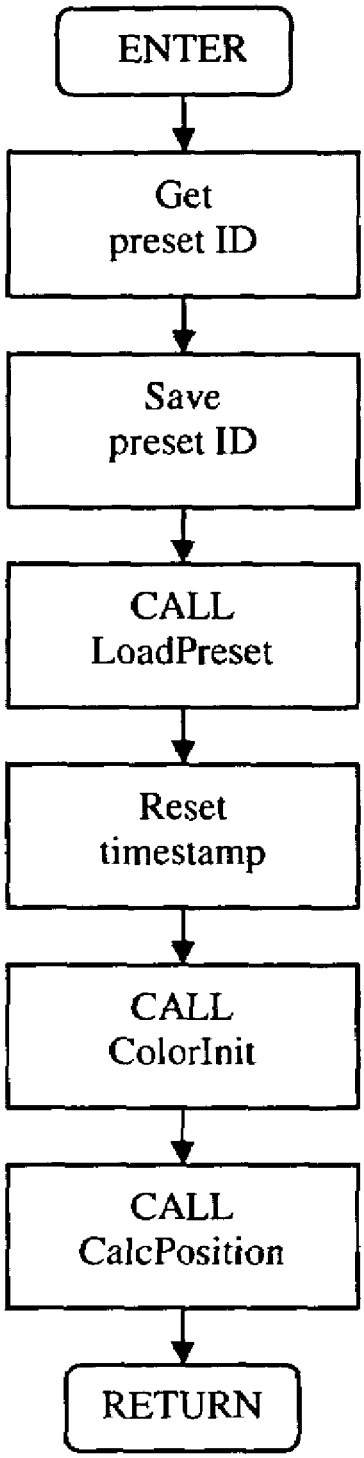
FIG. 9 illustrates a flow chart that represents the functional Packet C handler subroutine, ProcPacketC, which is called by the Main function, according to one embodiment of the present invention.

Referring to FIG. 9, the subroutine ProcPacketC reads the packet preset ID and uses its value to update the current controller 10 preset ID and saves it in memory 16. ProcPacketC then calls LoadPreset to load the specified color sequence from memory 16, resets the controller 10 synchronization timestamp, calls the subroutine ColorInit to initialize the color sequence array indices and calls the subroutine CalcPosition to determine the color sequence position before returning to the calling function, Main.

Figure 10:
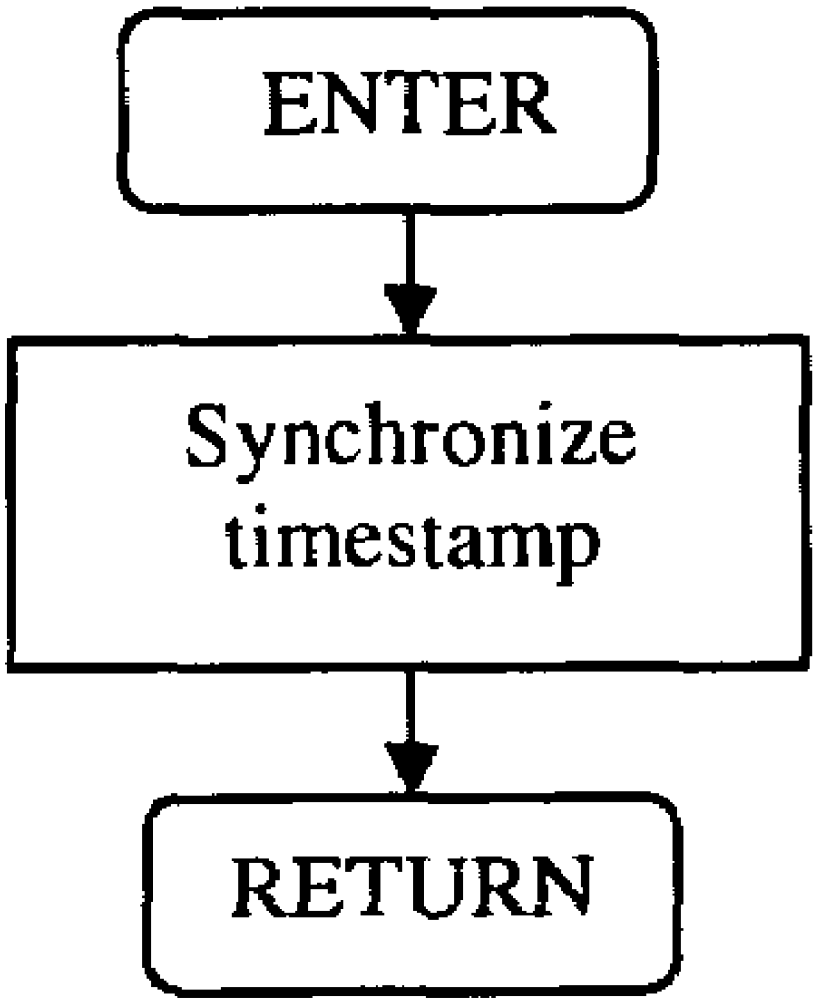
FIG. 10 illustrates a flow chart that represents the functional Packet D handler subroutine, ProcPacketD, which is called by the Main function, according to one embodiment of the present invention.

Referring to FIG. 10, the subroutine ProcPacketD sets the controller 10 synchronization timestamp to the Type D packet timestamp value before returning to the calling function, Main.

Figure 11:
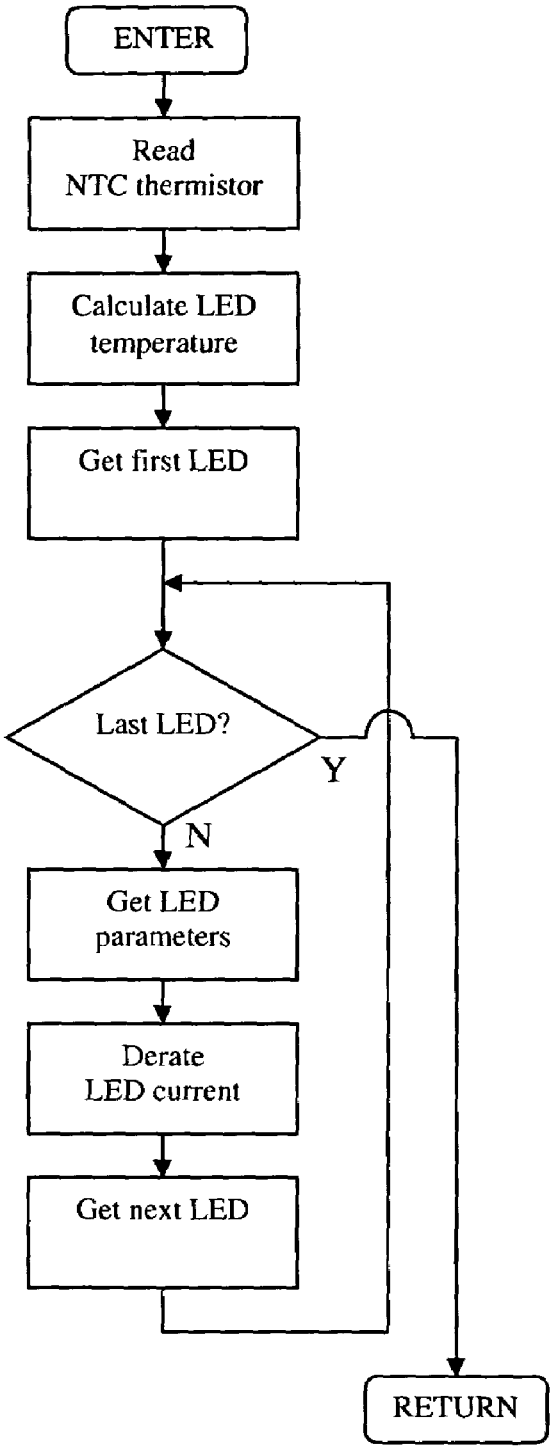
FIG. 11 illustrates a flow chart that represents the thermistor measurement and LED derating determination subroutine, ReadNTC, which is called by the Main function, according to one embodiment of the present invention.

Referring to FIG. 11, the subroutine ReadNTC reads the resistance of the NTC thermistor by means of analog-to-digital converter 14, and calculates the approximate ambient temperature for the operation of the light-emitting elements. ReadNTC subsequently reads the temperature dependency parameters of the light-emitting elements from the system data stored in memory 16 for each light-emitting element type and derates the drive current of the light-emitting elements accordingly such that the junction temperatures of the light-emitting elements remain within their safe operating limits before returning to the calling function, Main.

Figure 12:
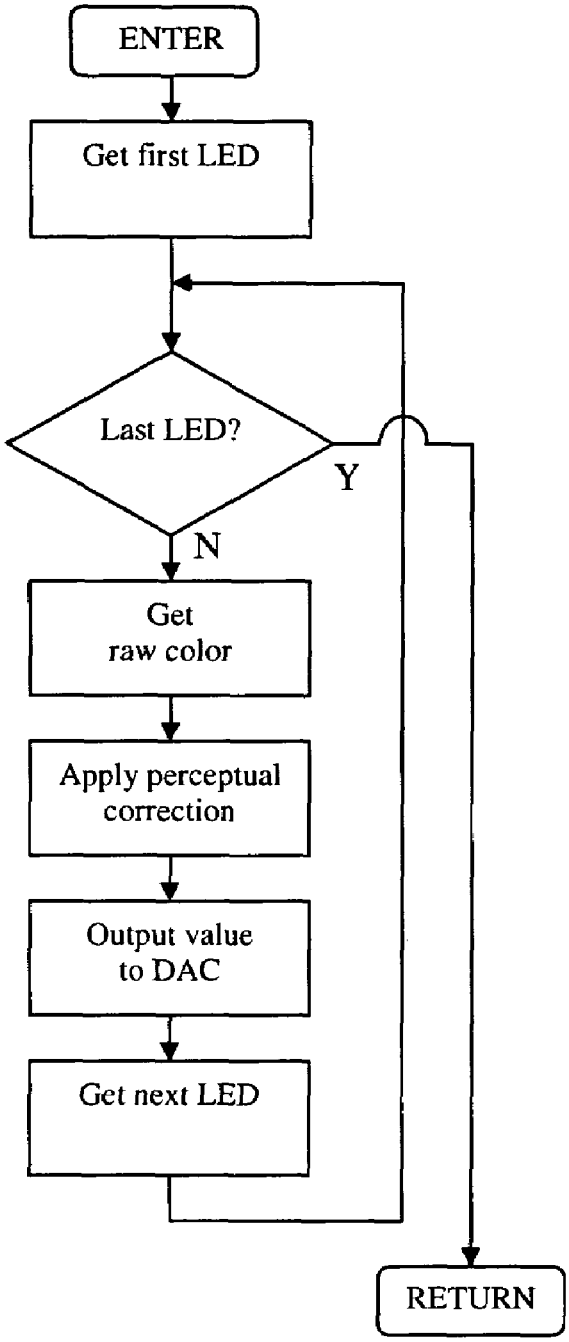
FIG. 12 illustrates a flow chart that represents the modified square law intensity determination and digital-to-analog conversion subroutine, UpdateDACs, which is called by the Main function, according to one embodiment of the present invention.

Referring to FIG. 12, the subroutine UpdateDACs performs a perceptual correction factor calculation for the raw color of each light-emitting element type and outputs the perceptually corrected drive current value to the digital-to-analog converters 11, 12 and 13 before returning to the calling function Main. In one embodiment of the present invention, the outputs define duty factors for corresponding pulse width modulators, which are used to control the light-emitting elements. The "raw color" is the triplet of red, green, and blue intensity values, for example, representing the current color as determined from a DMX512 color packet or a color sequence.

Figure 13:
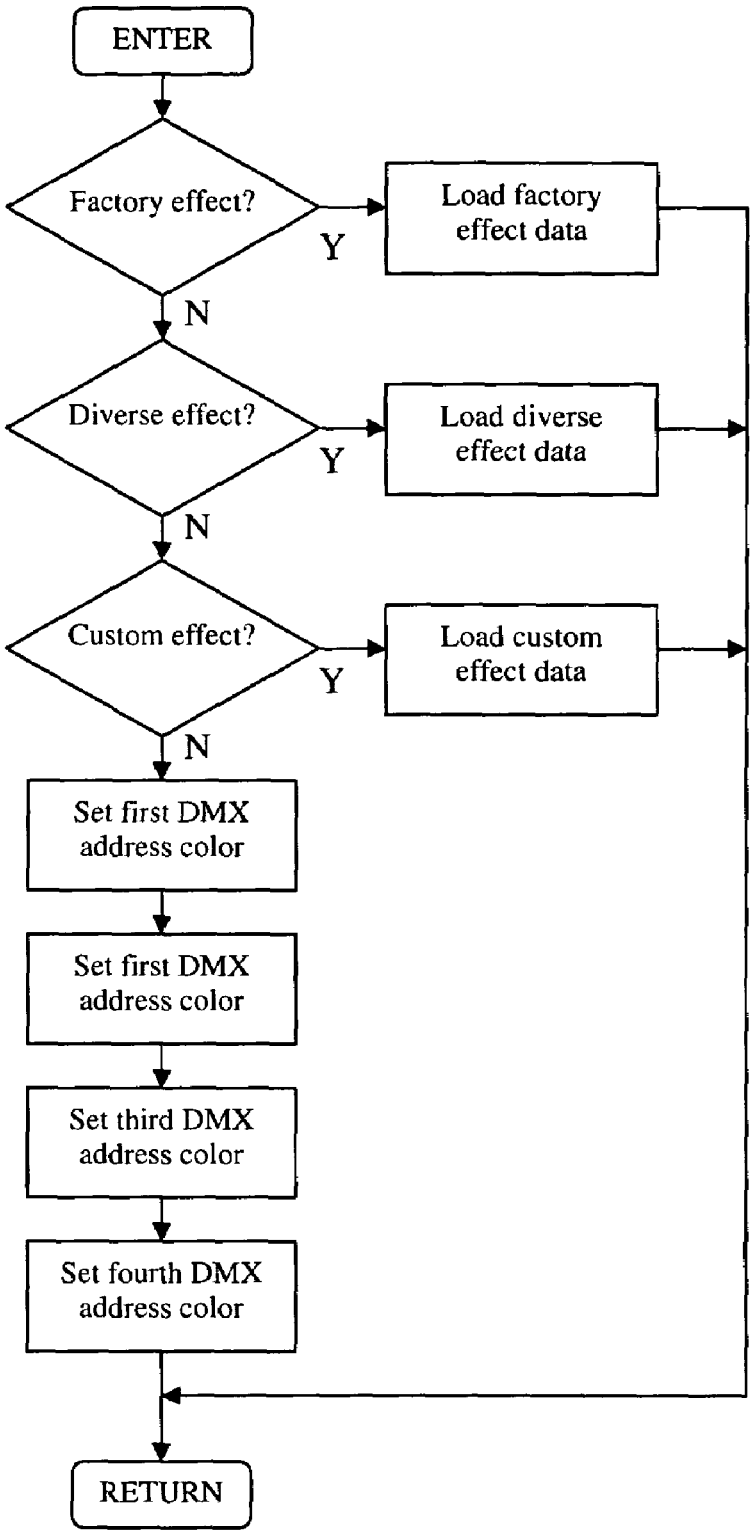
FIG. 13 illustrates a flow chart that represents the color sequence data load subroutine, LoadPreset, which is called by the Initialize, ProcPacketA and ProcPacketC functions, according to one embodiment of the present invention.

Referring to FIG. 13, the subroutine LoadPreset first determines whether the color sequence specified by the current preset ID is a factory color sequence. If it is, the specified color sequence is loaded from memory 16. If the color sequence specified by the current preset ID is not a factory color sequence, LoadPreset determines whether the specified color sequence is a diverse effect, and if so loads the specified color sequence from memory 16.

If the specified color sequence is not a diverse effect, LoadPreset determines whether the specified color sequence is a user-defined custom effect, and if so loads the specified color sequence from memory 16.

If the specified color sequence is not a custom effect, LoadPreset sets the red, green, and blue colors of light-emitting elements 31, 32, and 33 according to the current DMX512 address of the controller 10 so as to generate a unique color sequence by which the DMX512 address can be remotely determined by visually examining the lighting fixture or a correspondingly illuminated surface.

Upon completion of the above logic, LoadPreset returns to the calling function, Main.

Figure 14:
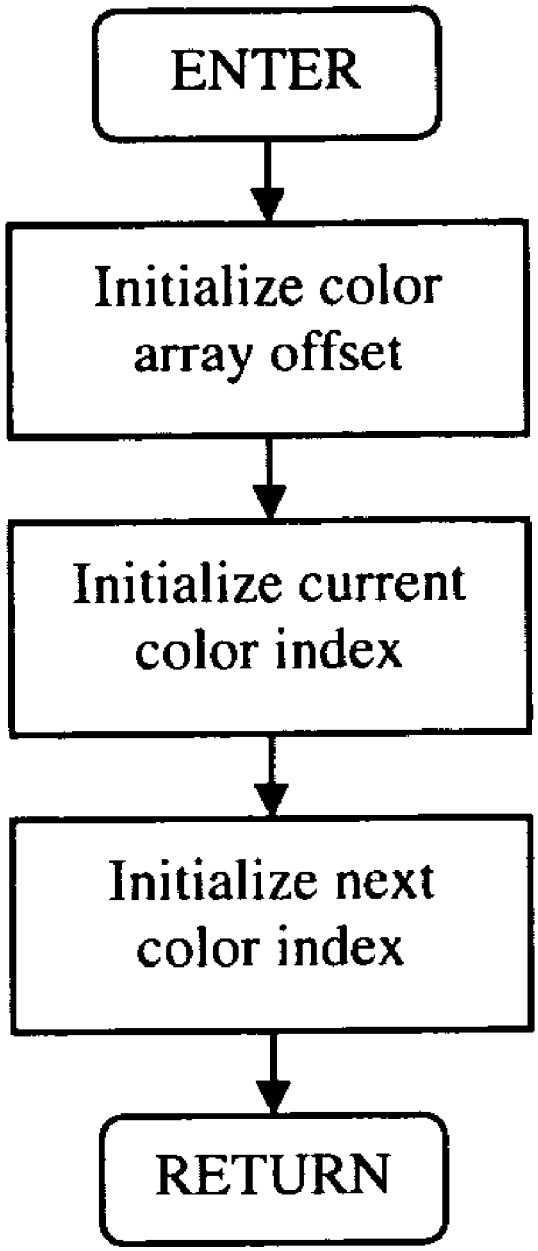
FIG. 14 illustrates a flow chart that represents the color sequence initialization subroutine, ColorInit, that is called by the Initialize, ProcPacketA, ProcPacketB, and ProcPacketC functions, according to one embodiment of the present invention.

Referring to FIG. 14, the subroutine ColorInit initializes the color sequence array offset, the current color sequence array index, and the next color sequence array index before returning to the calling function, Main.

It has been empirically observed that when a multiplicity of light fixtures are repeatedly strobed in unison, it may appear that the strobe timing is slightly delayed between adjacent light fixtures. This visual illusion can be paradoxically eliminated by randomly varying the strobe duration of each lighting fixture by a few milliseconds. For the purposes of the present invention, this process is referred to as "jittering."

Figure 15:
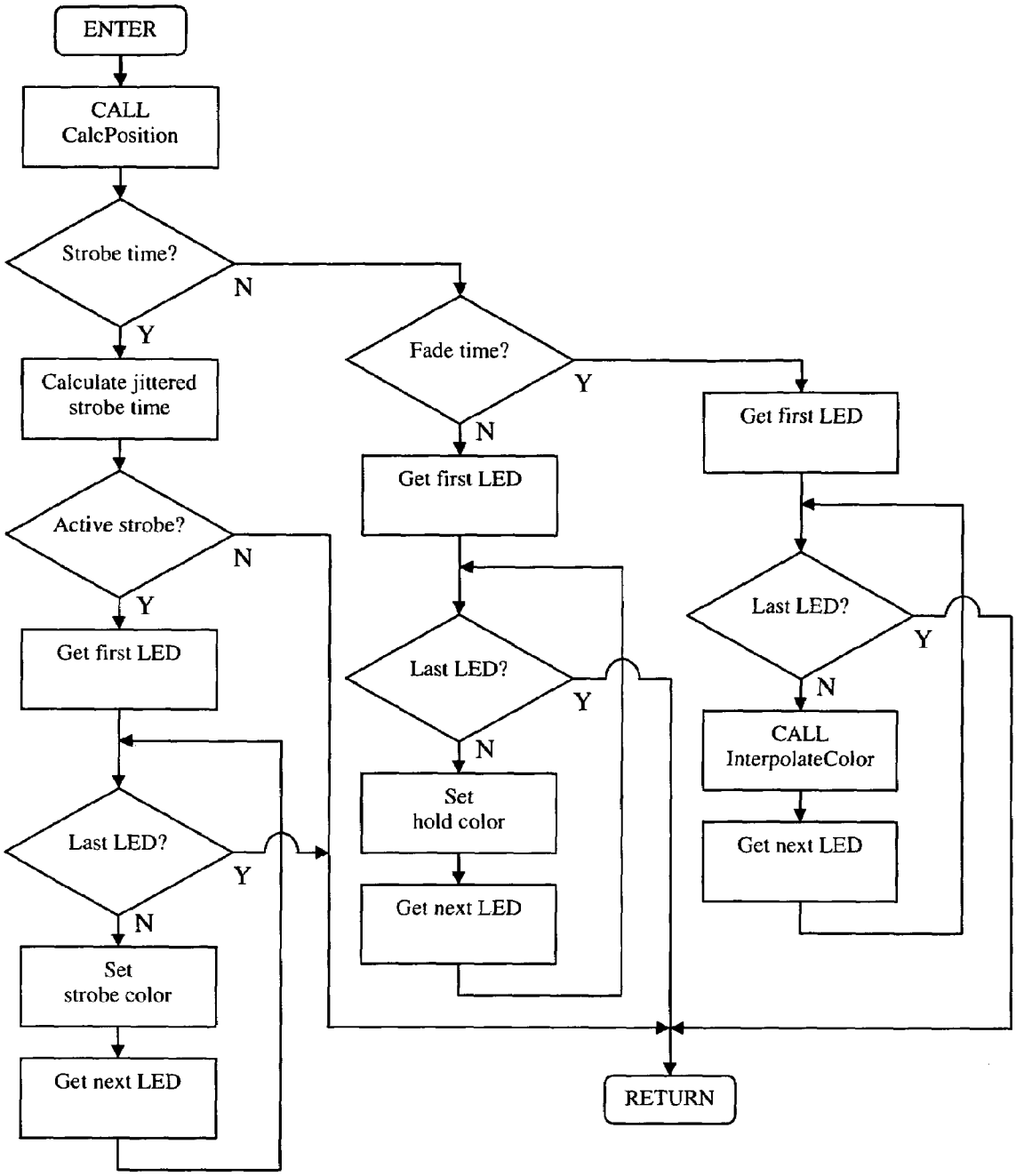
FIG. 15 illustrates a flow chart that represents the current color determination subroutine, CalcColor, which is called by the Main function, according to one embodiment of the present invention.

Referring to FIG. 15, the subroutine CalcColor takes advantage of this effect by first calling the subroutine CalcPosition to determine the color sequence position before determining whether the color sequence includes strobing. If it is, CalcColor then calculates the jittered strobe time duration before determining whether the current color sequence position is within a strobe interval. If it is, then CalcColor sets the strobe color defined by the color sequence data for each light-emitting element type before returning to the calling function.

If the color sequence does not include strobing, CalcColor determines whether the current color sequence position is within a fade interval during which the displayed color is faded from the current color to the next color in the color sequence. If it is, then CalcColor calls the subroutine InterpolateColor for each light-emitting element type before returning to the calling function.

If the current color sequence position is not within a fade interval, it is within a hold interval during which the current color in the color sequence remains constant. CalcColor therefore sets the current color for each light-emitting element type before returning to the calling function.

Figure 16:
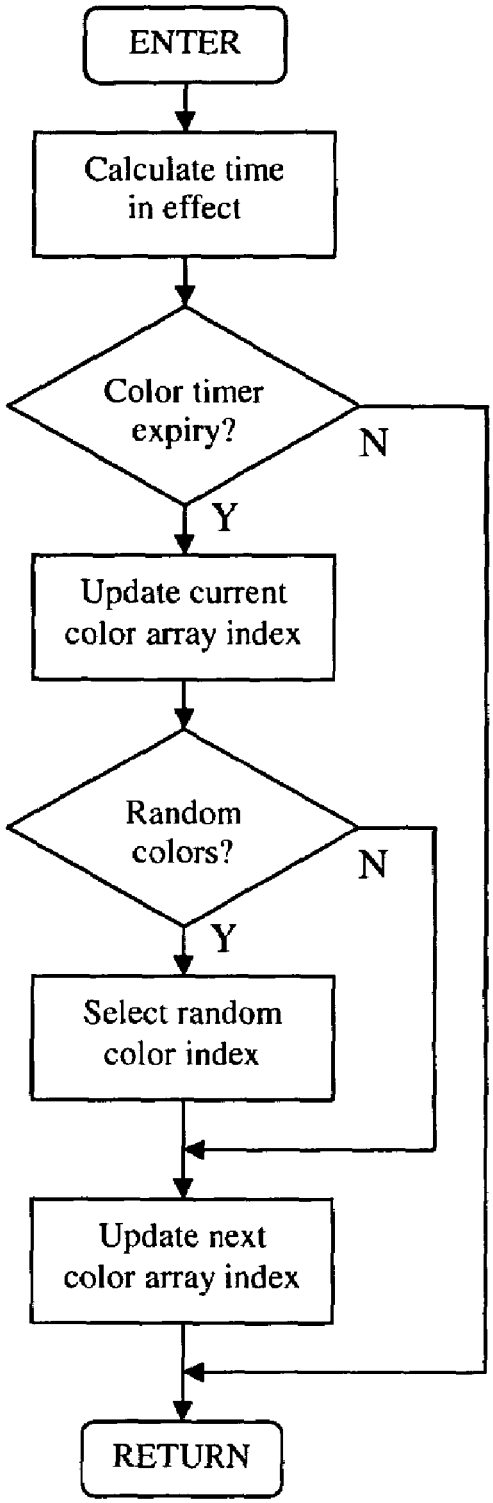
FIG. 16 illustrates a flow chart that represents the color sequence position determination subroutine, CalcPosition, which is called by the Initialize, ProcPacketA, ProcPacketB, ProcPacketC, and CalcColor functions, according to one embodiment of the present invention.

Referring to FIG. 16, the subroutine CalcPosition first calculates the time interval from the beginning of the current repetition of the color sequence, which it then uses to determine the current color sequence array index and hence the current color.

If the color sequence position results in the current color sequence array index to be incremented, CalcPosition determines whether the color sequence comprises fixed or random colors. If the color sequence comprises random colors, CalcPosition selects a random color sequence array index other than the current index to indicate the next color in the color sequence. Otherwise, the next color in the color sequence is determined by the next entry in the color sequence array, modulo the specified number of colors in the array.

Upon completion of the above logic, CalcPosition returns to the calling function, Main.

Figure 17:
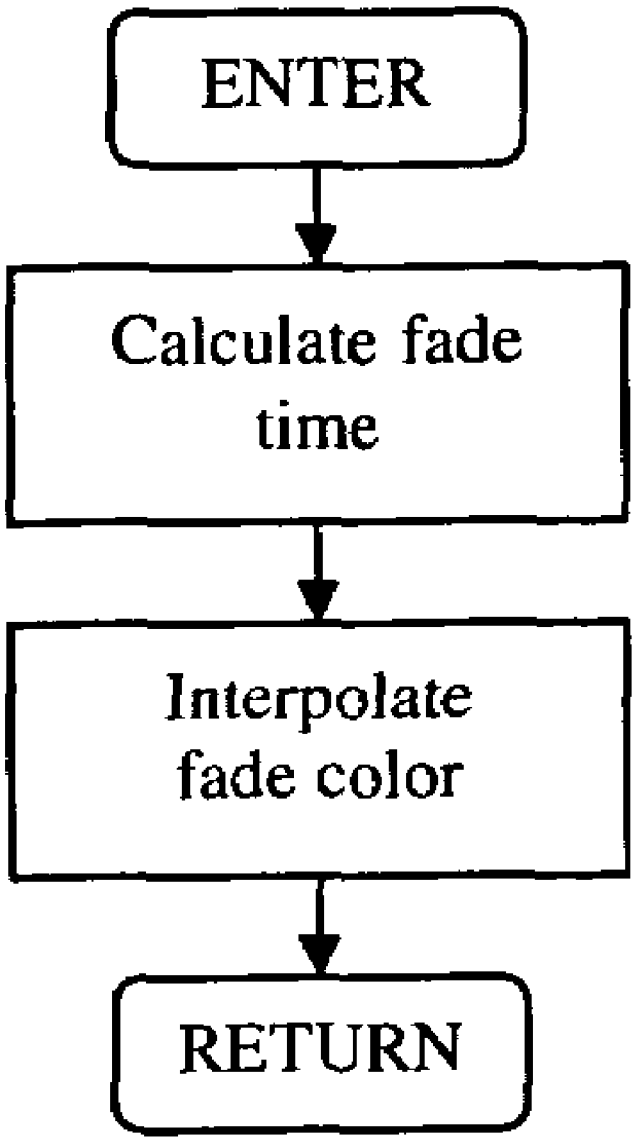
FIG. 17 illustrates a flow chart that represents the color fade interpolation subroutine, InterpolateColor, which is called by the CalcPosition function according to one embodiment of the present invention.

Referring to FIG. 17, the subroutine InterpolateColor calculates the fade time as determined from the color sequence array data and the color sequence position, and then linearly interpolates the current color from the current and next colors in the color sequence before returning to the calling function, Main.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A programmable lighting system comprising:

a) a plurality of light-emitting elements for generating light output of one or more wavelengths; and b) a controller having one or more attributes, the controller operatively coupled to the plurality of light-emitting elements, the controller for controlling the light output of the light-emitting elements, the controller being responsive to hierarchically encoded input data, the hierarchically encoded input data comprising a non-null start code having a value, the controller in response to the non-null start code determining which of the one or more attributes of the controller are to be affected by the hierarchically encoded input data, wherein the value of the non-null start code identifies which of the one or more attributes of the controller is affected and wherein the controller is adapted for connection to a source of power.

2. The programmable lighting system according to claim 1, wherein the non-null start code instructs the controller to initiate an action to be performed, said action selected from the group comprising: assigning one or more addresses to the controller, saving user-defined color sequences, selecting a factory preset color sequence, synchronizing timing between two or more controllers.

3. The programmable lighting system according to claim 2, wherein the non-null start code instructs the controller to set one or more serial numbers in the controller.

4. The programmable lighting system according to claim 1, wherein the controller comprises a serial port for receiving the hierarchically encoded input data, a real-time clock, memory for storing at least a portion of the hierarchically encoded input data and a plurality of converters for providing appropriate signals to the light-emitting elements for control thereof, wherein the serial port, real-time clock, memory and converters are operatively coupled together.

5. The programmable lighting system according to claim 1 further comprising a thermistor operatively coupled to the controller, the thermistor for measuring a temperature of the lighting system.

6. The programmable lighting system according to claim 1, wherein the controller has a unique serial number and one or more group addresses.

7. A method for controlling a programmable lighting system having a controller and a plurality of light-emitting elements operatively coupled thereto, the controller having one or more attributes, the method comprising the steps of:

a) generating hierarchically encoded input data, the hierarchically encoded input data comprising a non-null start code having a value;

b) transmitting hierarchically encoded input data to the controller;

c) determining, in response to the value of the non-null start code, a first controller attribute of the one or more attributes of the controller intended to be affected by the hierarchically encoded input data;

d) assigning or modifying the first controller attribute in response to the hierarchically encoded input data; and e) controlling light output of the plurality of light-emitting elements by the controller.

8. The method according to claim 7, wherein the non-null start code instructs the controller to initiate an action to be performed, said action selected from the group comprising: assigning one or more addresses to the controller, saving user-defined color sequences, selecting a factory preset color sequence, synchronizing timing between two or more controllers.

9. The method according to claim 8, wherein the action of assigning one or more addresses to the controller comprises the steps of:

reading the frame data and determining type of frame data regarding the one or more addresses of the controller;

updating address attributes of the controller based on the determined type of the frame data; and saving in controller memory the updated address attributes.

10. The method according to claim 8, wherein the action of saving user-defined color sequences comprises the steps of:

a) extracting from the frame data one or more addresses;

b) comparing said one or more addresses with current controller address;

c) if a match is determined, reading said user-defined color sequences from the frame data; and d) saving in controller memory the user-defined color sequences.

11. The method according to claim 8, wherein the action of selecting a factory preset color sequence comprises the steps of:

a) extracting from the frame data information defining a factory preset color sequence;

b) executing defined factory preset color sequence.

12. The method according to claim 8, wherein the action of synchronizing information between two or more controllers comprises the steps of:

a) extracting a time stamp from the frame data;

b) resetting controller time stamp based on the extracted time stamp.

13. The method according to claim 7, further comprising initializing the one or more attributes of the controller prior to generating hierarchically encoded input data.

14. The method according to claim 7, further comprising the step of reading a thermistor, thereby determining a temperature reading representative of temperature of the lighting system, thereby enabling derating of one or more of the plurality of light-emitting elements depending on the temperature reading.

15. The method according to claim 7, further comprising the steps of detecting raw color data regarding a particular color of one or more light-emitting elements, applying a perceptual correction factor to the raw color data thereby generating corrected color data and transmitting the corrected color data to a converter associated with the one or more light-emitting elements of the particular color.

* * * * *